US006016975A

United States Patent [19]

Amaduzzi

[11] Patent Number: 6,016,975

[45] Date of Patent: Jan. 25, 2000

[54] AXIALLY-OPERATED DUAL-ACTION WASHING GUN

[75] Inventor: Pietro Amaduzzi, Rubiera, Italy

[73] Assignee: Arrow Line S.R.L., Rubiera, Italy

[21] Appl. No.: 09/070,744

[22] Filed: May 1, 1998

[30] Foreign Application Priority Data

Jul. 31, 1997 [IT] Italy ..... RE97A0054

[51] Int. Cl.[7] ..... B05B 1/16

[52] U.S. Cl. ..... 239/447; 239/449; 239/443

[58] Field of Search ..... 239/436, 443, 239/445–449

[56] References Cited

U.S. PATENT DOCUMENTS

| | | | |
|---|---|---|---|
| 2,333,767 | 11/1943 | Davis | 239/449 |
| 3,363,842 | 1/1968 | Burns | 239/449 X |
| 3,514,042 | 5/1970 | Freed . | |
| 4,095,747 | 6/1978 | Anderson | 239/443 X |
| 4,785,998 | 11/1988 | Takagi | 239/449 X |
| 4,886,213 | 12/1989 | Kristensen . | |
| 5,242,116 | 9/1993 | Bonezzi | 239/443 X |
| 5,344,080 | 9/1994 | Matsui | 239/449 |

FOREIGN PATENT DOCUMENTS

| | | | |
|---|---|---|---|
| 479494 | 11/1975 | U.S.S.R. | 239/447 |

*Primary Examiner*—Lesley D. Morris
*Attorney, Agent, or Firm*—Browdy and Neimark

[57] ABSTRACT

Dual-action washing gun consisting of two concentric and coaxial tubes (7, 12), the internal one of which operates at high pressure, the initial part of the internal tube being provided with a cylindrical bush (4) having a hole (5) formed in its walls, and an element for shutting off this hole, consisting of a valve member (18) axially slidable in a sealing manner on the bush.

17 Claims, 2 Drawing Sheets

11
7
13'
13'

18
4
20
5
21
16
22
8
9
11
VI
13'
14
7
12
12
12
VI
23
6'

22
3
2
1

AXIALLY-OPERATED DUAL-ACTION WASHING GUN

BACKGROUND OF THE INVENTION

The present invention relates to a gun for performing washing operations by means of a low-pressure and high-pressure jet of water or water solution.

In the sector relating to the washing of objects (such as, for example, machinery, equipment, floors or walls, etc.) equipment referred to by the name of "hydrocleaners" are known, said equipment consisting essentially of an electric pump or volumetric motor pump operating at high pressure, in the region of about 100 bar or more, which supply water or water solution inside a flexible pipe connected to a gun suitably manipulated by the operator.

Said gun comprises a first part consisting of a shut-off valve, generally in the form of a trigger-operated gun; and a second part consisting of the actual spout which terminates in a supply nozzle from which the jet emerges. Supply guns which are able to operate in two different pressure modes, high and low, are known to exist on the market: this is generally obtained by arranging alongside the body of the gun a handgrip which, suitably rotated by the operator, activates or deactivates a second jet alongside the main high-pressure jet, resulting in the low-pressure operating mode, or the high-pressure operating mode, depending on the position of the handgrip.

These known guns, however, are not easy to maneuver and also quite bulky on account of the lateral handgrip designed to activate the "high pressure" or "low pressure" condition. Moreover, in the known guns, it is not easy to determine the operating position of the handgrip operating system, namely whether it is in the "high pressure" position or in the "low pressure" position since it is difficult to see the position of the operating handgrip, rotation of which results in the desired operating mode. Moreover, in said known guns, the operation for activating the "high pressure" mode is fairly slow, being determined by screwing of the handgrip until a closed position of a conical-seat valve is reached; and this operation is also unreliable since the conical sealing seat of the valve may be subject to rapid wear, adversely affecting correct operation of the gun.

Finally, said known guns are heavy and therefore tiring to use.

BRIEF SUMMARY OF THE INVENTION

An object of the present invention is to provide a washing gun with two pressure modes, namely a low-pressure mode and a high-pressure mode, which is lighter and easier to use and in which it is possible to see immediately and easily which operating mode has been selected and in which the operation for changing between the two modes is also more rapid and instinctive.

Another object is also to achieve a more pleasing aspect of the gun and a more uniform distribution of the jet, whatever the operating mode thereof.

These objects are achieved by designing a gun consisting of two concentric tubes, the internal one of which is intended to operate at high pressure, the initial part of this internal tube being provided with a cylindrical bush having at least one radial hole, and an element for shutting off this hole, consisting of a second bush axially slidable in a sealing manner on the said bush.

BRIEF DESCRIPTION OF THE DRAWINGS

This invention will emerge more clearly from the description of an example of embodiment, illustrated hereinbelow with the aid of two illustrative plates.

In these plates.

DETAILED DESCRIPTION OF THE PREFERRED EMBODIMENT(S)

Figure 1:
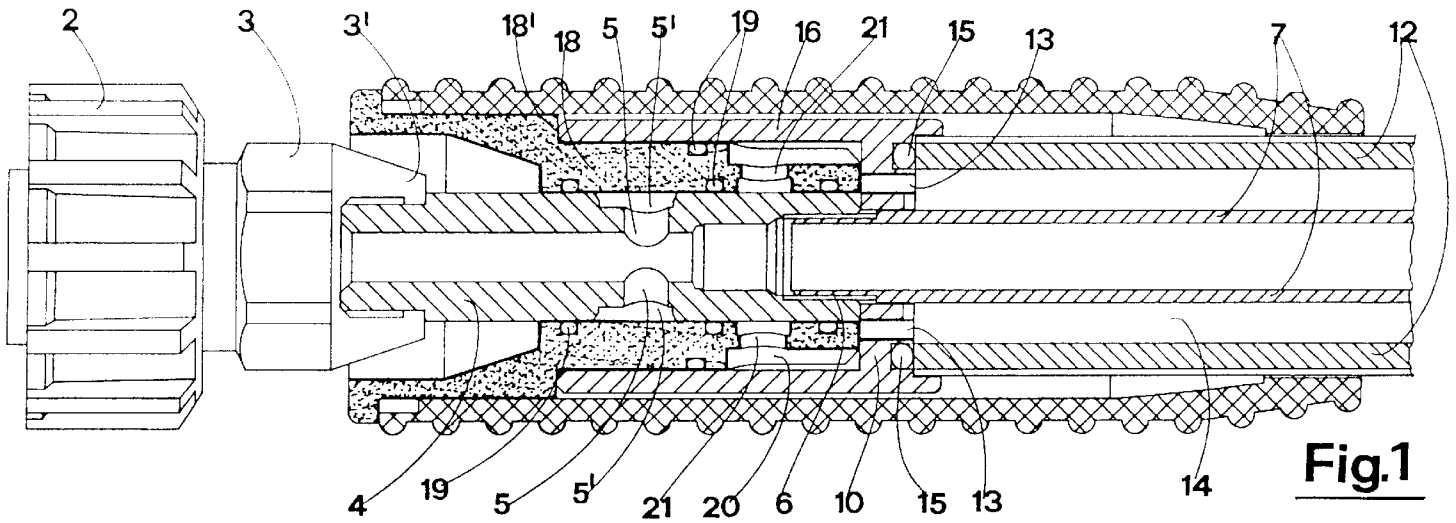
FIG. 1 shows a partially sectioned view of a gun designed in accordance with the invention, along an axial plane of the initial part of the gun, when the gun is in the position for high-pressure operation.

With reference to these figures, 1 denotes in its entirety a washing gun with a dual operating mode, realized in accordance with the teachings of the invention. 2 denotes a ring for connection to the source supplying high-pressure water, generally consisting of a valve for shutting off a high-pressure pipe connected to a known hydrocleaner. 3 denotes a threaded connector for connecting the ring 2 and a cylindrical bush 4 which is internally bored along its axis and is also transversely bored with two radial holes 5.

At the opposite end to the connector 3, the cylindrical bush 4 is joined via a thread at 6 to a rigid high-pressure tube 7 which supplies at the opposite end the high-pressure nozzle 8 of the gun 1.

This nozzle 8 is supported by a nozzle-carrying connector 9 to which the other end of the rigid high-pressure tube 7 is joined via a thread at 6'.

A first bored disk 10 and a second bored disk 11, between which a tubular element 12 coaxial with the tube 7 is arranged, are provided respectively between the bush 4 and the threaded connector 9, situated at the tow ends of the rigid tube 7.

This tubular element 12 forms the external part of the gun 1. The first bored disk 10 has, in the central zone, a hole through which the high-pressure tube 7 passes; in the middle zone, a series of holes 13 opposite the annular chamber 14 defined by the tube 7 and by the external tube 12, and more peripherally with respect to these holes 13, it has a bearing shoulder 15 for the external tube 12, where there is provided a sealing element consisting of a ring of elastomeric material.

Similar holes 13', again situated opposite the annular chamber 14, and also an associated corresponding bearing shoulder for the tube 12, are provided on the second bored disk 11.

The two bored disks 10 and 11 are provided respectively at the ends of the external tube 12 and are axially joined together by the central tube 7 by means of two threaded parts 6, 6'.

In it peripheral area, the disk 10 is intergrally connected to a cylindrical stub pipe 15 coaxial with the disk 10 so as to assume a cup shape, the disk 10 forming the bottom thereof and the stub pipe 16 forming the body.

The stub pipe 16 and the bush 4 are therefore concentric and coaxial with each other, a cylindrical annular chamber 17 being defined between them.

An axially sliding valve member 18 in the form of a truncated cylinder is provided inside this chamber 17, said valve member sliding sealingly between the bush 4 and the stub pipe 16, sealing means 19 (consisting of rings made of elastomeric material) being provided both at the cylindrical interface between the bush 4 and the valve member 18 and at the cylindrical interface between the valve member 18 and the stub pipe 16.

Two diametrically opposite, radial, holes 21 are provided on the truncated-cylinder body of the valve member 18, in a zone of the valve member body enclosed between two sealing elements 19.

These holes 21 are provided in a position so as to coincide with the holes 5 of the bush, when the valve member 18 is situated in one of the two end positions of its travel. A groove 20 is provided at the outlet of the hole 21 so as to connect the annular chamber 17 to the hole 21.

It is envisaged that the valve member 18 may be displaced axially along the cylindrical surface of the bush 4, the travel thereof being delimited by two end positions.

The first of these positions is defined (FIG. 1) by the interference between an external shoulder 18' formed on the body of the valve member 18 and the end 16' of the stub pipe 16.

The second of the positions (FIG. 2) is defined by the interference between the end of the cylindrical body 18 and the protruding end 3' of the connector 3 onto which the bush 4 is threaded.

In order to ensure correct operation of the annular sealing members 19 during sliding of the valve member 18 on the body of the bush 4, the outlet of the holes 5 outside the bush 4 is tapered in the manner of a chamfer 5'.

Figure 2:
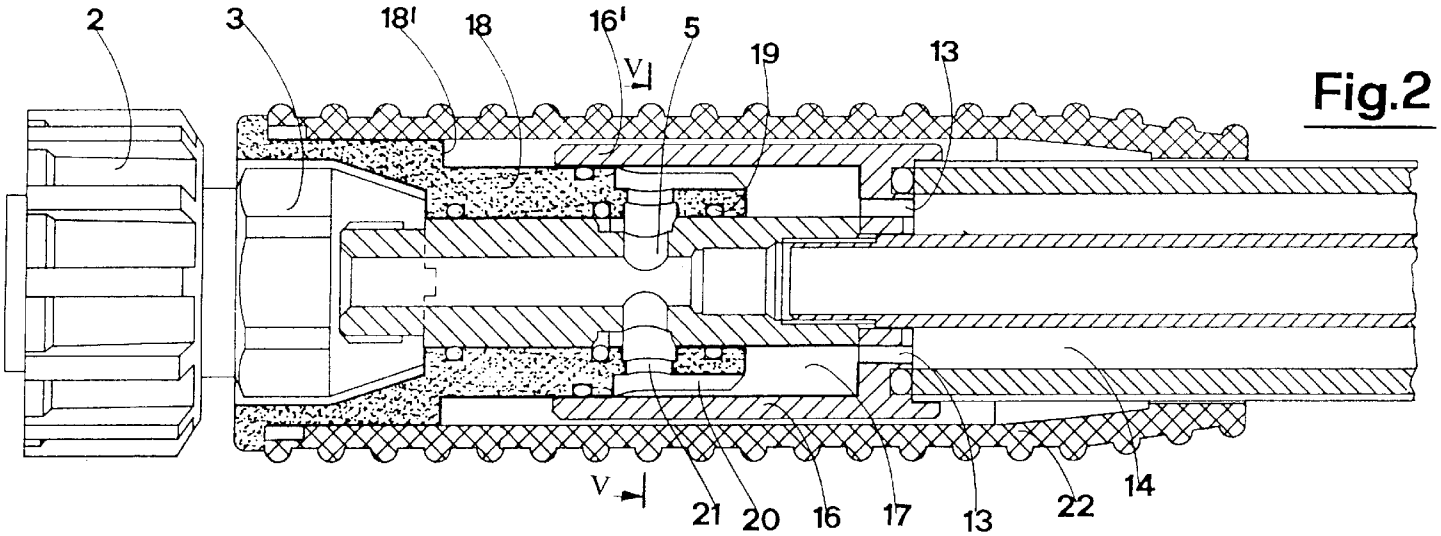
FIG. 2 shows the same view, but in the position for low-pressure operation.

These two positions shown in FIG. 1 and FIG. 2 correspond, respectively, to high-pressure operation and low-pressure operation of the gun 1.

An external handgrip 22 is rigidly connected to the valve member 18 in the region of the shoulder 18'; a protective cover 23 is also provided at the front end of the gun 1.

Figures 3, 4, 5, 6:
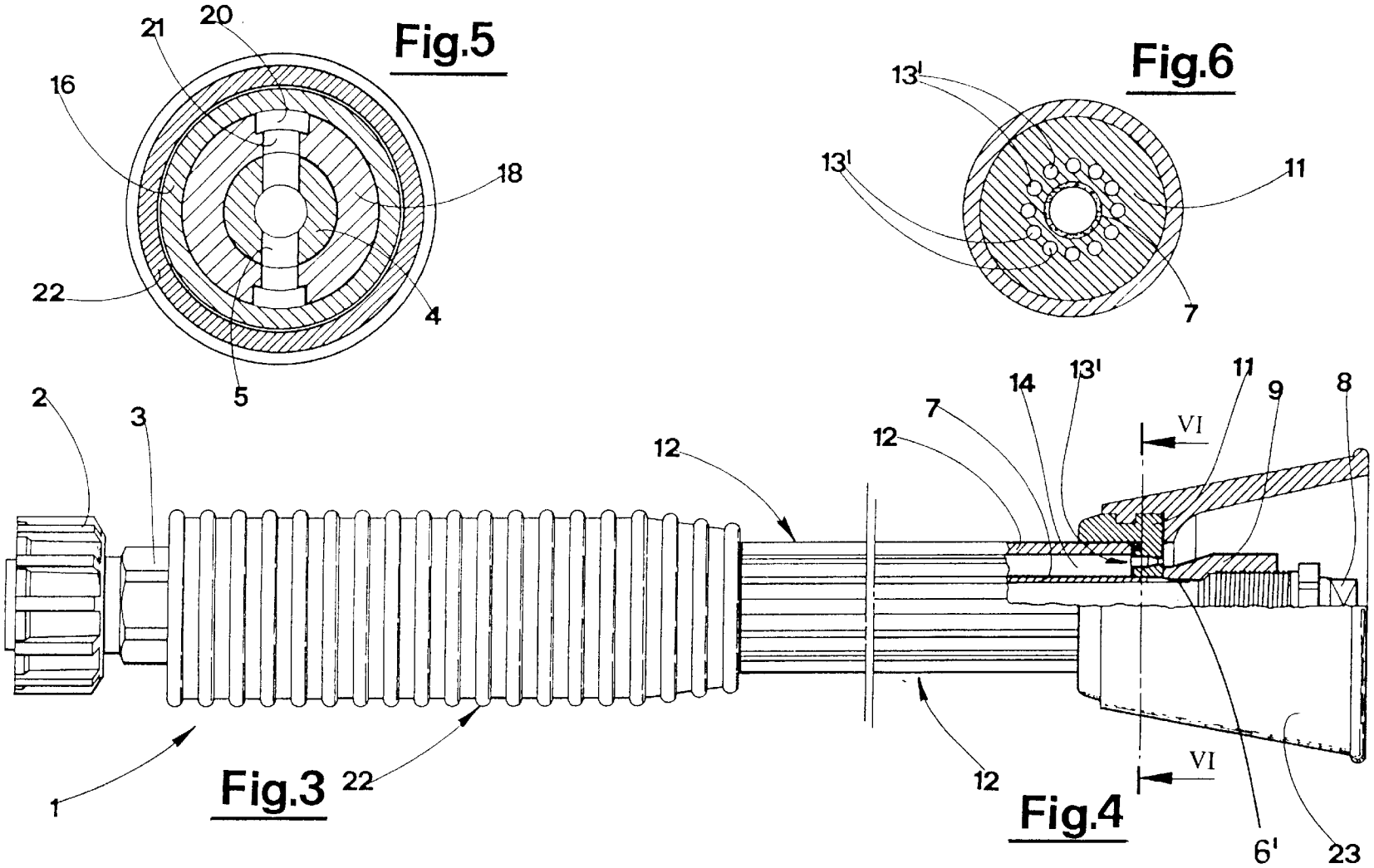
FIG. 3 is a view of the outside of initial part of the gun, when it is set for high-pressure operation.
FIG. 4 is a partially sectioned view of the end part of the gun.
FIGS. 5 and 6 show a cross-section through the gun along the axis V—V of FIG. 2 and the axis VI—VI of FIG. 4, respectively.

The mode of operation is as follows:

When the handgrip 22 for activating the operating mode is positioned forwards, as shown in FIG. 1 and FIG. 3, the gun is set for operation in high-pressure mode.

The high-pressure water enters via the connector 3, travels along the bored bush 4 which is completely sealed since the holes 5 are closed by the valve member 18 with associated sealing means 19.

The water therefore enters into the duct 7 and travels along it as far as the high-pressure nozzle 8.

When the operator moves the handgrip 22 backwards with an axial movement, positioning it as shown in FIG. 2, the gun is set for operation in low-pressure mode.

In this position of the handgrip 22, the holes 21 of the valve member 18 (which is rigidly connected to the handgrip 22) are located opposite the holes 5 in the bush 4: the water is therefore able to flow out freely through the hole 21 and the groove 20, enter into the chamber 17, and then, via the holes 13, enters into the chamber 14, traveling along the gun, and finally emerges through the holes 13' of the second disk 11.

A small part of the water will continue to flow out through the nozzle 8 since opening of the outflow apertures 21, 20 establishes a by-pass upstream of the high-pressure tube 7. Sealing of the tubular element 12 at its two ends, in the region of the bearing shoulders on the disks 10 and 11, is ensured by tight screwing of the threads 6, 6' at the end of the tube 7, respectively on the bush 4 and on the connector 9; this tight screwed connection causes the ends of the tube 12 to press firmly against the respective bearing shoulders on the disks 10 and 11 between which it is enclosed, ensuring both the mechanical stability of the gun and a hydraulic seal in the low-pressure tube 12 obtained by the insertion of suitable sealing members made of elastomeric material.

The invention, which is illustrated in the figures described above as an example of embodiment which is purely indicative and non-limiting, may be realized in the form of numerous variants, such as, for example, with a different arrangement of the apertures or holes 13, 13' on the disks 10 and 11, or with a different arrangement of the annular sealing means 19.

A further advantage of the invention consists in the uniformity of the jet in the low-pressure mode since it is uniformly distributed radially and therefore has a more effective washing action.

What is claimed is:

1. A dual-action washing gun operable in two pressure modes including a high-pressure mode and a low-pressure mode, the gun being insertable downstream of a piping from a hydrocleaner; the gun comprising:

a portion coupling to the piping supplied by a hydrocleaner;

a spout at an end of the gun opposite the coupling;

a trigger-operating shut-off valve disposed between the spout and a coupling to the piping supplied by a hydrocleaner;

an outer tube (12);

an internal tube (7) suppliable at high pressure and concentric with the outer tube, the internal tube including, adjacent the coupling, a cylindrical first bush (4); the first bush including at least one radial hole (5);

a second bush axially slidable in a sealed manner on the first bush and further comprising a valve member (18) for shutting off the radial hole.

2. Dual-action gun as claimed in the preceding claim 1, wherein the valve member (18) is rigidly connected to an external handgrip (22).

3. Dual-action gun as claimed in the preceding claim number 1, wherein the outlet of the radial hole (5) outside the bush (4) is tapered in the form of a chamfer (5').

4. Dual-action gun as claimed in the preceding claim number 1, wherein the valve member (18) is provided with at least one radial hole (21) in a position such as to coincide with a hole (5) in the bush (4), when the valve member (18) is located in one of the end positions of its travel.

5. Dual-action gun as claimed in the preceding claim number 4, wherein the hole (21) is enclosed between two annular sealing elements (19).

6. Dual-action gun as claimed in the preceding claim number 4, wherein the outside body of the valve member (18) is provided with a groove (20) in the region of the outlet of the hole (21), so as to connect the annular chamber (17) to the hole (21).

7. Dual-action gun as claimed in the preceding claim number 1, wherein the valve member (18) may be displaced axially along the cylindrical surface of the bush (4), the travel thereof being delimited by two end stops (3', 16').

8. Dual-action gun as claimed in the preceding claim number 1, wherein two bored disks (10, 11) which are axially joined together by the central tube (7) by means of the two threaded parts (6, 6') are provided respectively at the ends of the external tube (12).

9. Dual-action gun as claimed in the preceding claim number 8, wherein the bored disks (10, 11) have a series of holes (13, 13') in the region of the annular chamber (14) which forms an interspace between the internal tube (7) and the external tube (12).

10. Dual action gun as claimed in the preceding claim 1, wherein the valve member (18) is rigidly connected to an external handgrip (22).

11. Dual-action gun as claimed in the preceding claim 1, wherein the outlet of the radial hole (5) outside the bush (4) is tapered in the form of a chamfer (5').

12. Dual-action gun as claimed in the preceding claim 1, wherein the valve member (18) is provided with at least one radial hole (21) in a position such as to coincide with a hole (5) in the bush (4), when the valve member (18) is located in one of the end positions of its travel.

13. Dual-action gun as claimed in the preceding claim 12, wherein the hole (21) is enclosed between two annular sealing elements (19).

14. Dual-action gun as claimed in the preceding claim 12, wherein the outside body of the valve member (18) is provided with groove (20) in the region of the outlet of the hole (21), so as to connect the annular chamber (17) to the hole (21).

15. Dual-action gun as claimed in the preceding claim 1, wherein the valve member (18) may be displaced axially along the cylindrical surface of the bush (4), the travel thereof being delimited by two end stops (3', 16').

16. A dual-action washing gun operable in two pressure modes including a high-pressure mode and a low-pressure mode, the gun being insertable downstream of a piping from a hydrocleaner; the gun comprising:

an elongated tube structure further comprising a high-pressure tube (7) and a low-pressure tube (12);

an end portion coupling the elongated tube structure to the piping supplied by a hydrocleaner and including a shut-off valve operable to shut off slow from the piping to the low-pressure tube;

a spout fixed at an end of the elongated tube structure opposite the end portion, the spout including a high-pressure nozzle communicating with the high-pressure tube and a low-pressure nozzle communicating with the low-pressure tube.

17. The dual-action washing gun according to claim 16, wherein the high-pressure tube is disposed inside the low-pressure tube.

* * * * *